US006695016B2

(12) United States Patent
Buck

(10) Patent No.: US 6,695,016 B2
(45) Date of Patent: Feb. 24, 2004

(54) HOUSING OF A DEVICE FOR THE TREATMENT OF GASES HOTTER THAN THE AMBIENT TEMPERATURE

(75) Inventor: Klaus-Dieter Buck, Soest (DE)

(73) Assignee: Rheinhold & Mahla AG, München (DE)

( * ) Notice: Subject to any disclaimer, the term of this patent is extended or adjusted under 35 U.S.C. 154(b) by 69 days.

(21) Appl. No.: 09/785,213

(22) Filed: Feb. 20, 2001

(65) Prior Publication Data

US 2001/0015140 A1 Aug. 23, 2001

(30) Foreign Application Priority Data

Feb. 21, 2000 (DE) ..... 100 07 844

(51) Int. Cl.[7] ..... F16L 9/14

(52) U.S. Cl. ..... 138/149; 138/155; 454/44

(58) Field of Search ..... 138/149, 155, 138/143; 52/406.2, 407.4, 407.5, 404.3, 506.03, 512, 794.1, 218; 454/44

(56) References Cited

U.S. PATENT DOCUMENTS

| | | | | |
|---|---|---|---|---|
| 3,909,907 A | * | 10/1975 | Davis | 29/407 |
| 4,557,297 A | | 12/1985 | Montana | |
| 4,936,069 A | * | 6/1990 | Hunter et al. | 52/309.4 |
| 5,437,312 A | * | 8/1995 | Gumangan et al. | 138/149 |
| 5,460,206 A | * | 10/1995 | Sansoucy | 138/149 |
| 5,848,508 A | * | 12/1998 | Albrecht | 52/309.9 |
| 5,875,599 A | * | 3/1999 | McGrath et al. | 52/586.2 |

FOREIGN PATENT DOCUMENTS

| | | |
|---|---|---|
| DE | 34 11 924 | 3/1984 |
| DE | 42 25 448 | 7/1992 |
| DE | 196 31 291 | 8/1996 |
| EP | 0 342 661 | 5/1989 |

* cited by examiner

*Primary Examiner*—James Hook
(74) *Attorney, Agent, or Firm*—Browdy and Neimark

(57) ABSTRACT

A housing of a device for the treatment of gases hotter than the ambient temperature, in particular flue gases, comprises an exterior frame made of supports. At the interior side of said frame an insulating wall is arranged which comprises an interior side metal sheet and an exterior side metal sheet, wherein insulating material having an extremely low heat conductivity is arranged between said metal sheets.

9 Claims, 4 Drawing Sheets

HOUSING OF A DEVICE FOR THE TREATMENT OF GASES HOTTER THAN THE AMBIENT TEMPERATURE

BACKGROUND OF THE INVENTION

1. Field of the Invention

The present invention relates to a housing of a device for the treatment of gases hotter than the ambient temperature, in particular flue gases.

2. Background Art

Such housings, for example those of electric flue gas filters, comprise a frame which is provided with a closed interior wall and which is provided on its exterior side with a very thick insulation layer. The constructional effort needed to manufacture such housings is extremely high due to the fact that the frames are arranged in the interior of the housing and are therefore exposed to high temperatures.

SUMMARY OF THE INVENTION

It is an object of the present invention to design a housing of the generic type in such a way that it can be manufactured with as little effort as possible.

According to the invention, this object is achieved by a frame made of supports; an insulating wall arranged at the interior side of said frame and defining an interior space, said insulating wall comprising an interior metal sheet; an exterior metal sheet; and insulating material of an extremely low heat conductivity arranged between said interior and said exterior metal sheet.

The key feature of this invention lies in the fact that the wall of the housing itself is formed by a relatively thin insulating wall which in turn consists of insulating plates having an extremely low heat conductivity. The entire frame of the housing is located in the area of the ambient temperature, i.e. on the cold side, while only the inner side of the insulating wall facing the interior space containing the hot gas is located on the hot side. The measures according to the invention allow a significant reduction of the constructional effort and therefore the cost compared to the prior art solutions. As the frame is located on the cold side, it can be designed in a much easier way. A treatment device in the sense of this invention may also consist of flue gas channels through which hot flue gases are only transported.

Further features, advantages and details of the invention result also from the following description of an example embodiment with reference to the drawings.

DESCRIPTION OF THE PREFERRED EMBODIMENT

Figure 1:
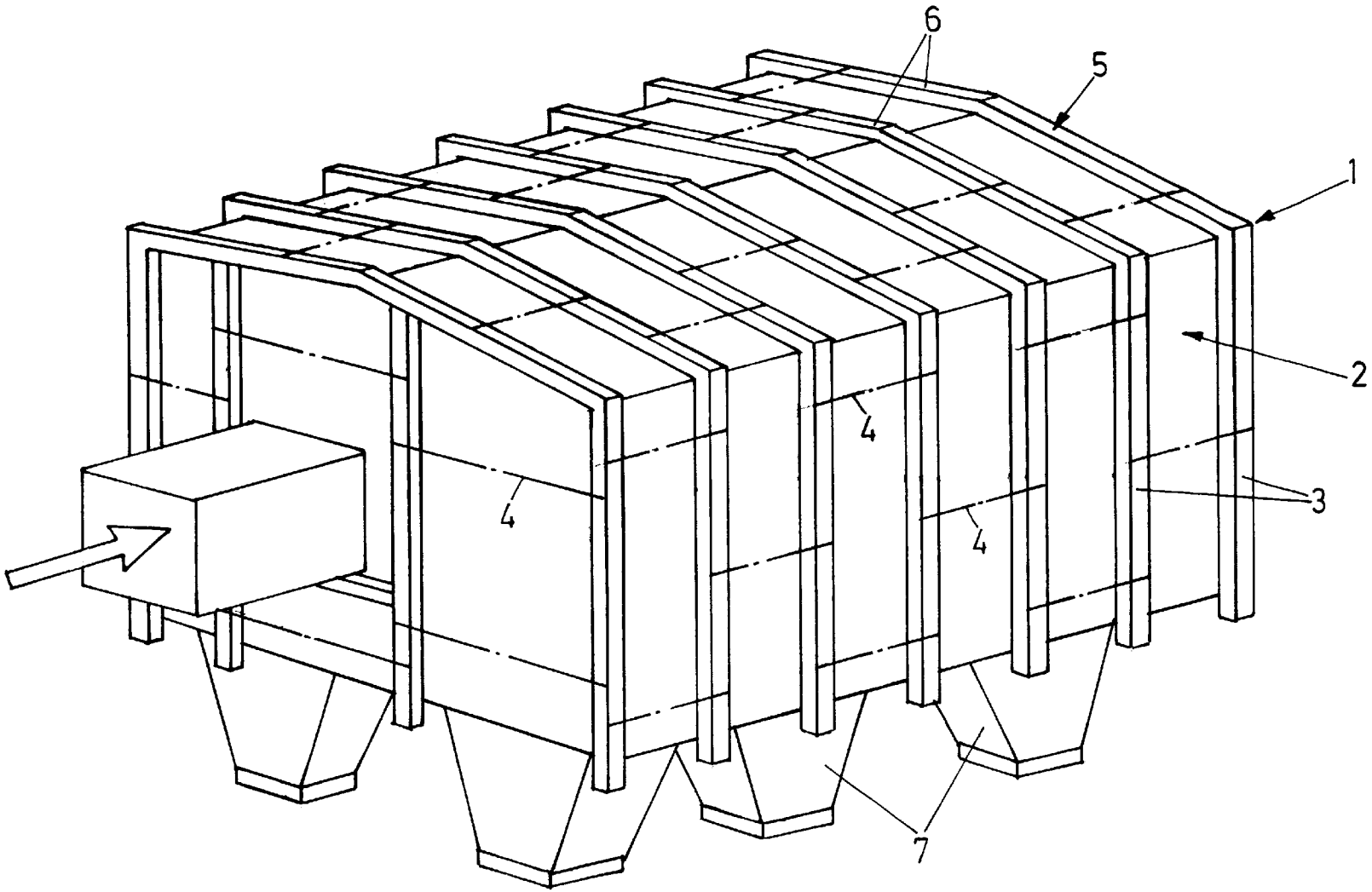
FIG. 1 shows a schematic perspective view of a housing of an electric flue gas filter.

As can be seen in FIG. 1, a housing of an electric filter used for purifying hot flue gases essentially comprises an exterior frame 1 and an interior insulating wall 2. Said frame

1 comprises vertical supports 3 and horizontal stanchions 4 (only indicated) as well as rafters 6 supporting a roof 5. At least the supports 3 and the rafters 6 are basically formed in an identical manner. The insulating wall 2 forms not only the lateral and longitudinal walls but also the vapour barrier of the roof. In the floor portion, discharge bunkers 7 are formed, from which the substances separated from the flue gases during the purification process are discharged in the usual manner.

Figure 2:
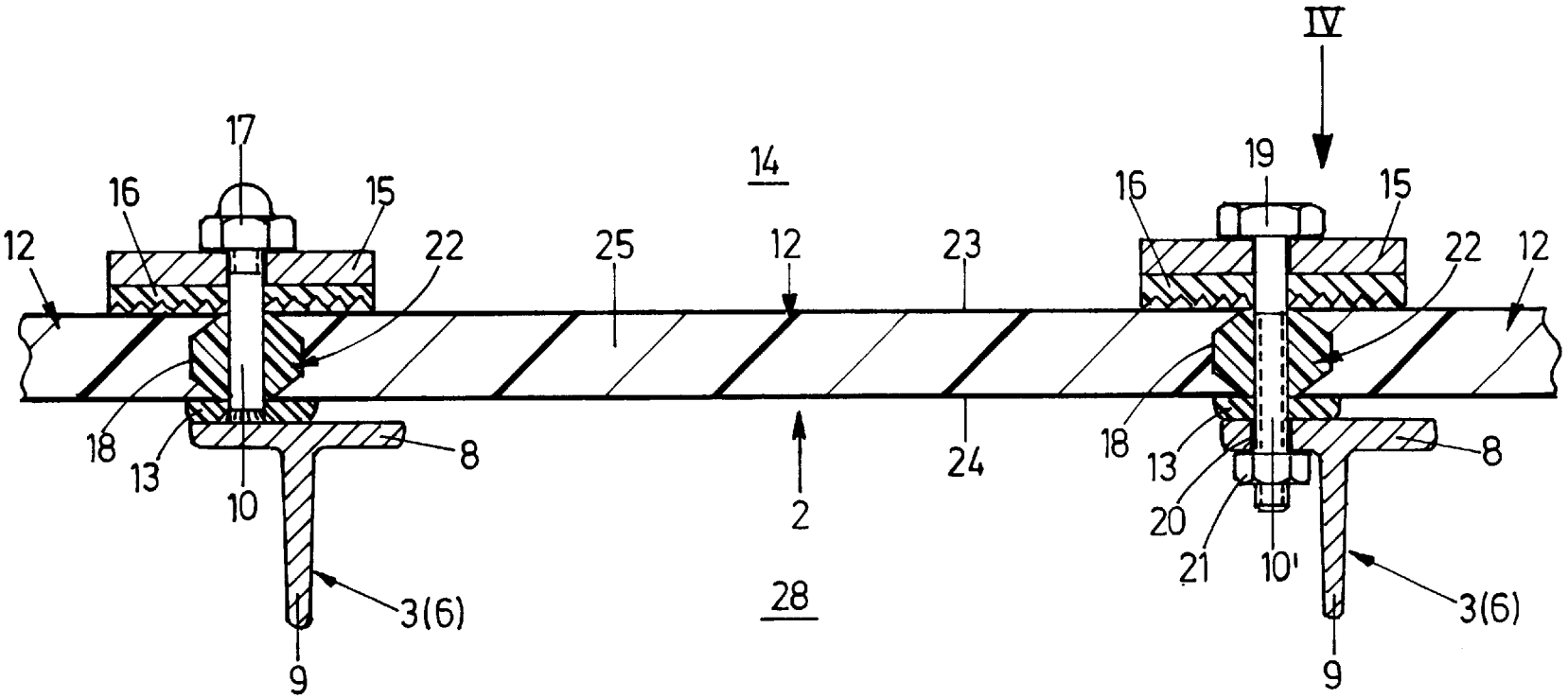
FIG. 2 shows a sectional cross-section of an insulating wall of the housing extending over two adjacent supports.
Figure 3:
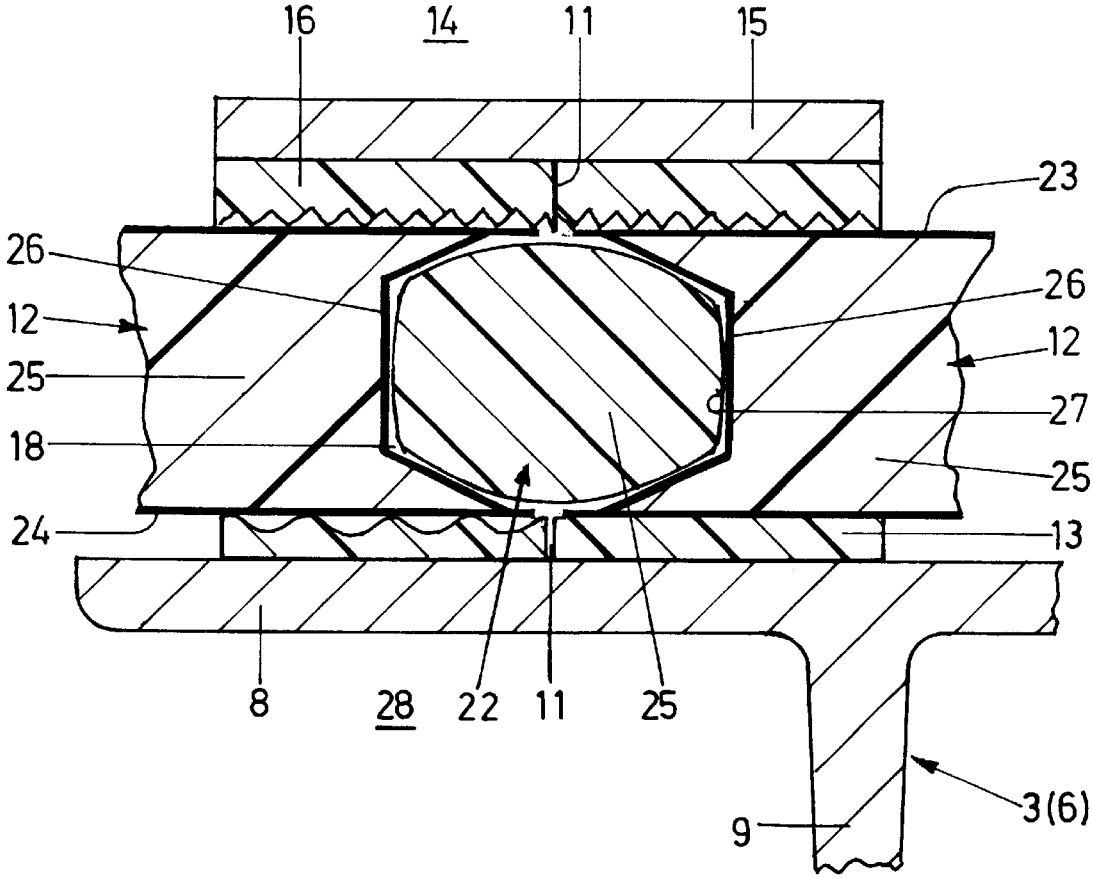
FIG. 3 shows a cross-section of the insulating wall in the region of a junction point of two insulating plates in an image enlarged compared to FIG. 2.
Figure 4:
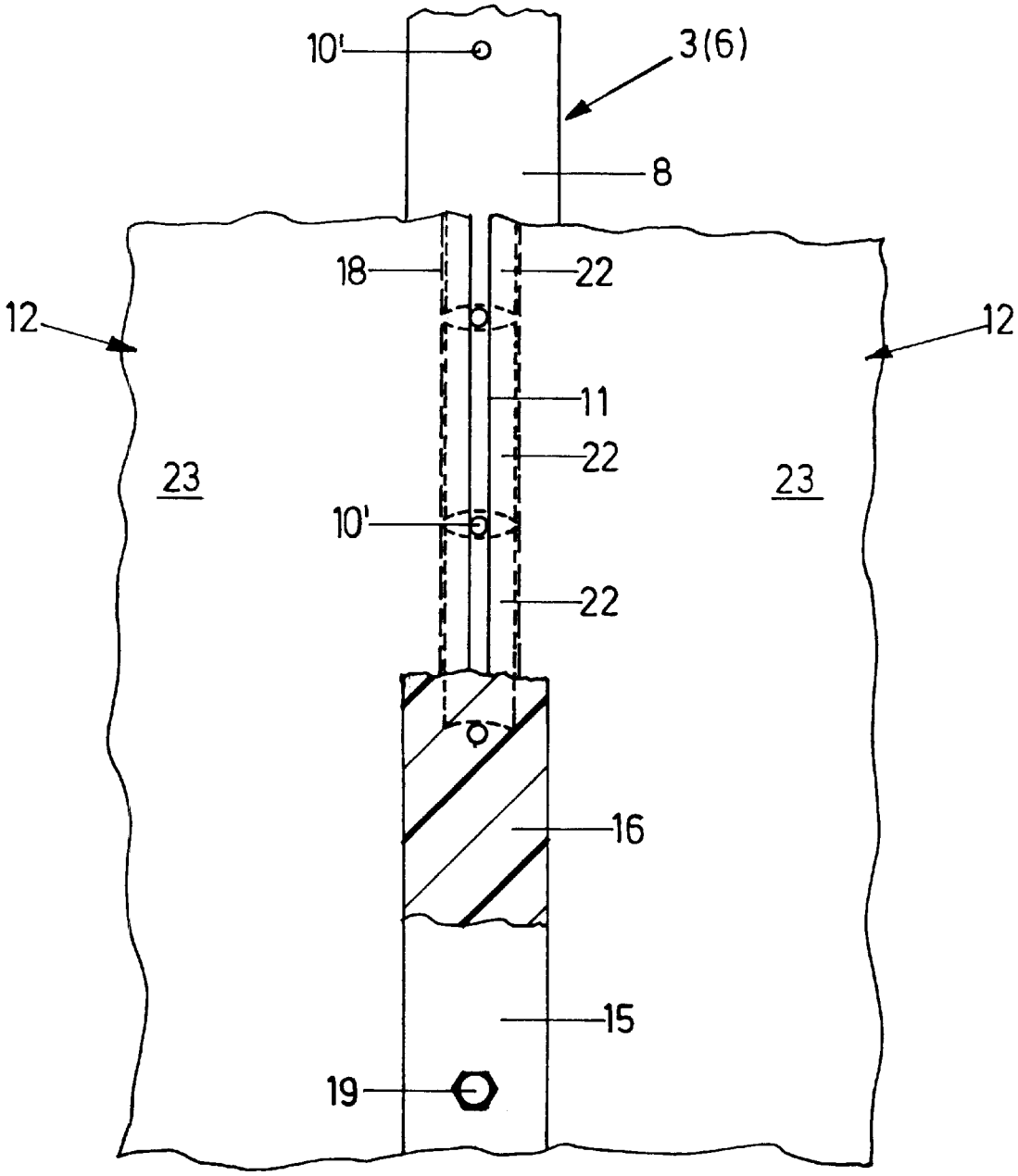
FIG. 4 shows a partially opened view of the insulating wall according to the viewing arrow IV in FIG. 2.

As becomes clear especially from FIGS. 2 and 3, the supports 3 and the rafters 6 consist of T- or double-T beams onto the flange 8 of which facing the insulating wall 2 said insulating wall 2 is mounted. To this end and according to the embodiment shown in the left part of FIG. 2, a supporting bolt 10 formed as a threaded bolt is welded to said flange 8 apart from the centre towards web 9 of the beam. Said bolt is located at the butt joint 11 between two adjacent insulating plates 12 forming said insulating wall 2 which extend, as can be seen in FIG. 2, from one to the next adjacent support 3. As can be seen in FIG. 4, a large number of said supporting bolts 10 are arranged spaced from one another along the length of a support 3 and/or a rafter 6. A sealing 13 non-resistant to temperature is arranged between said flange 8 and the facing side of said insulating plates 12 closely sitting to said flange 8 and said insulating plates 12 meeting at said butt joint 11 as well as to said supporting bolt 10. Said sealing may be formed as a flat or a lip sealing.

A pressure plate 15 extending over the entire length of said support 3 and/or said rafter 6 and formed as a flat profile is set onto said supporting bolts 10 on the side facing the interior space 14 of the housing, while a temperature-resistant sealing 16 is arranged between said pressure plate 15 and the surface of said insulating plates 12 facing the interior space 14 said sealing also crossing said butt joints 11 and sealingly sitting on said supporting bolt 10. Said sealing 16 may—as can be seen in FIGS. 2 and 3—be formed as a lip sealing. Said sealing 16 is resistant against the temperatures which may occur in the interior space 14 and on the side of the insulating plates 12 facing this interior space. In the embodiment comprising a supporting bolt 10, said insulating plates 12 and said seals 13, 16 are sealingly tightened and supported by a nut screwed onto the respective supporting bolt 10 from the interior space 14, for example a cap nut 17.

As can be seen in the right part of FIG. 2, a machine bolt may be provided as supporting bolt 10' the head 19 of which engages said pressure plate 15 and which insulating bodies 22 having a generally elliptical or circular cross-section are arranged at the location of the butt joints 11, with one insulating body 22 being arranged between each pair of support bolts 10 being adjacent in the longitudinal direction of the support 3 or the rafter 6.

As can be seen in FIG. 3, each of the insulating plates 12 is provided at its exterior side with a metal sheet 23 and 24, respectively, having a preferred thickness of 0.8 mm. The metal sheets 23, 24 are made of austenitic stainless steel, particularly the inner metal sheet 23 facing the interior space 14. Accordingly, at least the pressure plates 15 and the threaded bolts 10, 10' should be made of similar austenitic stainless steel. An insulating material 25 having an extremely high heat insulation capacity of, for example, $\lambda \approx 0.004$ W/mK, with the heat conduction definitely being $\lambda \leqq 0.01$ W/mK, is arranged between the metal sheets 23, 24. A suitable insulating material 25 is, for example, a so-called super-insulation as shown and described in the VDI-WÄRMEATLAS, Berechnungsblättter für den Wänrmeübergang [Association of German Engineers—

HEAT ATLAS, Calculation Sheets for Heat Transition], 5th edition 1988, VDI-VERLAG, pages Ke 1 through Ke 17. Preferably, a micro-porous thermal insulating material manufactured and distributed under the name WDS by Messrs. Wacker-Chemie GmbH is considered, the main component of which is highly dispersed silicic acid. It consists of microscopically tiny beads having a diameter between 5–30 nm. Thus, heat transfer due to solid body heat conductivity is kept at a minimum. During pressing this highly dispersed silicic acid to plates, a micro-cellular constitution is formed. Very tiny pore structures having a diameter of 0.1 micron are generated. Heat transfer by convection is minimised by trapping of gas molecules. The addition of infrared turbidising agents to the micro-porous silicic acid considerably reduces the infrared transparency. At Thus, heat transfer due to solid body heat conductivity is kept at a minimum. During pressing this highly dispersed silicic acid to plates, a microcellular constitution is formed. Very tiny pore structures having a diameter of 0.1 micron are generated. Heat transfer by convection is minimised by trapping of gas molecules. The addition of infrared turbidising agents to the micro-porous silicic acid considerably reduces the infrared transparency. At the same time, heat transfer by radiation is also minimised. Thus, this insulating material 25 arranged in the form of a plate between the metal sheets 23, 24 has an extremely low heat conductivity.

The insulating plates 12 are joined circumferentially at their outer edges, i.e. at the recesses 18, with connecting metal sheets 26 limiting said recess 18 by circumferential welding seams providing a gas-tight sealing so that the insulating plates 12 comprise gas-tightly sealed interior spaces containing the insulating material 25. Additionally, these interior spaces are partly evacuated in order to further reduce the overall heat conductivity. The connecting metal sheets 26 are also made of austenitic stainless steel having a low heat conductivity of, for example, $\lambda<20$ W/mK. For the purpose of reducing the heat conductivity, the thickness of the connecting metal sheets 26 is preferably reduced to 0.3 mm.

The insulating bodies 22 comprise as actual insulating material also said insulating material 25 and a resilient sheath 27, for example made of glass silk. Thus, the insulating bodies 22 are wholly resilient and absorb the thermal expansion of the insulating plates 12 while at the same time sitting tightly on the connecting surfaces 26 of the recesses 18 at all temperatures, i.e. in all expansion states of the insulating plates 12.

The mounting onto the stanchions 4 is similar to the method described above for the supports 3 and rafters 6.

It is obvious from the above description that the insulating wall 2 forms, on the one hand, the complete insulation of the housing and, on the other hand, the wall of said housing. The entire load-bearing structure, namely the frame 1, is arranged at the exterior side, i.e. in the environment 28 having the ambient temperature. Only the pressure plates 15, the temperature-resistant seals 16, the regions assigned to the supporting bolts 10 and 10', respectively, and the interior metal sheets 23 plus the insulating material 25 are exposed to the high temperatures in the interior space 14.

What is claimed is:

1. A housing of a device for the treatment of gases hotter than the ambient temperature, in particular flue gases, comprising a frame (1) made of supports (3) and having an interior side;

an insulating wall (2) arranged at the interior side of said frame (1) and defining an interior space (14) said insulating wall (2) comprising an interior metal sheet (23);

an exterior metal sheet (24); and insulating material (25) of an extremely low heat conductivity arranged between said interior and said exterior metal sheet (23, 24), wherein said insulating wall (2) is formed by insulating plates (12) arranged in the grid-like frame of said supports (3), said interior and exterior metal sheet (23, 24) of one insulating plate (12) are gas-tightly and circumferentially connected with a connecting metal sheet (26), said insulating plates (12) are partly evacuated.

2. A housing according to claim 1, wherein said insulating plates (12) are supported by their exterior metal sheet (24) towards flanges (8) of said supports (3).

3. A housing according to claim 2, wherein a sealing (13) is arranged between said exterior metal sheet (24) and said flange (8).

4. A housing according to claim 2, wherein said insulating material (25) has a heat conductivity $\lambda$, with $\lambda \leqq 0{,}01$ W/mK.

5. A housing according to claim 1, wherein supporting bolts (10, 10') are spaced apart from one another and mounted onto the support (3) in the longitudinal direction of the support, said supporting bolts (10, 10') being arranged in a butt joint (11) between two adjacent insulating plates (12); and wherein said supporting bolts (10, 10') hold pressure plates (15) facing the interior space (14) and pressing said insulating plates (12) against said supports (3).

6. A housing according to claim 5, wherein temperature-resistant seals (16) are arranged between said pressure plates (15) and said interior metal sheets (23).

7. A housing according to claim 5, wherein said insulating plates (12) are provided with recesses (18) in the vicinity of the butt joints (11), with insulating bodies (22) filling at least substantially said recesses (18) being arranged in the two recesses (18) facing each other of two insulating plates (12) which are in contact with each other at said butt joint (11).

8. A housing according to claim 7, wherein said insulating bodies (22) are formed by insulating material (25) and a sheath.

9. A housing according to claim 1, wherein said insulating material (25) is substantially formed by a micro-porous silicic acid.

* * * * *